United States Patent [19]

Illig et al.

[11] Patent Number: 4,759,537

[45] Date of Patent: Jul. 26, 1988

[54] APPARATUS FOR SEPARATING AND CONVEYING THE UPPERMOST SHEET OF A STACK OF SHEETS OR SHEET-LIKE ARTICLES

[75] Inventors: Egon Illig, Stuttgart; Ernst Bergner, Fellbach, both of Fed. Rep. of Germany

[73] Assignee: Fraumhofer-Gesellschaft zur Forderung der angewandten Forschung e.V., Fed. Rep. of Germany

[21] Appl. No.: 839,048

[22] Filed: Mar. 12, 1986

[30] Foreign Application Priority Data

Mar. 12, 1985 [DE] Fed. Rep. of Germany ..... 3508736

[51] Int. Cl.[4] ..... B65H 5/10

[52] U.S. Cl. ..... 271/11; 271/107; 271/93

[58] Field of Search ..... 221/211; 414/121; 271/94–96, 103, 106, 107, 108, 196, 11, 93, 194

[56] References Cited

U.S. PATENT DOCUMENTS

| | | | |
|---|---|---|---|
| 2,163,274 | 6/1939 | Dixon | 271/106 |
| 3,764,133 | 10/1973 | Gray et al. | 271/107 |
| 4,146,217 | 3/1979 | Barker et al. | 271/108 |
| 4,327,906 | 5/1982 | Frohlich et al. | 271/108 |
| 4,591,140 | 5/1986 | Illig et al. | 271/107 |

FOREIGN PATENT DOCUMENTS

| | | | |
|---|---|---|---|
| 814836 | 3/1981 | U.S.S.R. | 414/121 |

*Primary Examiner*—H. Grant Skaggs

*Attorney, Agent, or Firm*—Jones, Tullar & Cooper

[57] ABSTRACT

In order to be able in a simple manner to supply one or more suction pick-up devices periodically moved relative to the surface of a stack with driving energy, the suction pick-up device is connected to an air volume or source having substantially constant negative pressure over overpressure, and a valve assembly that periodically connects the suction pick-up device to the outside air. The valve assembly is incorporated in the connecting line between the suction pick-up device and the air volume. The valve assembly may be embodied with a control piston that is subject to the action of a restoring force, by a pneumatic multi-way valve having a regulattable frequency, or by a magnetic valve connected to a regulattable frequency generator. With the aid of a regulating device for the cross section of the vent opening, it is possible to generate an amplitude of the suction pick-up device movement that becomes progressively smaller from stroke to stroke after the movable suction pick-up device has been switched on, until it attains a complete standstill.

3 Claims, 10 Drawing Sheets

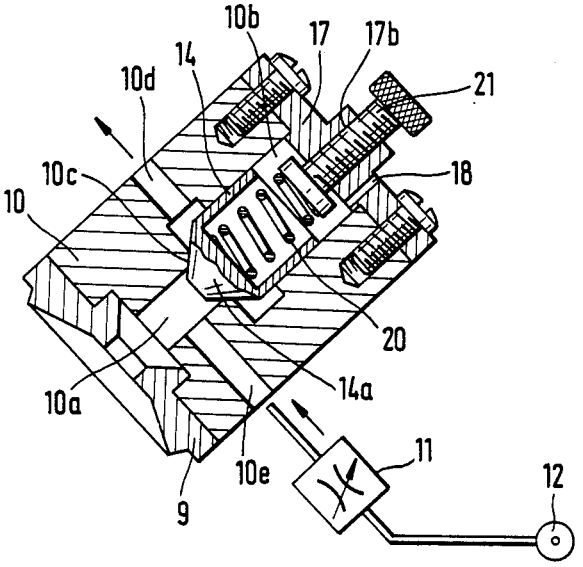
FIG.2
FIG.3
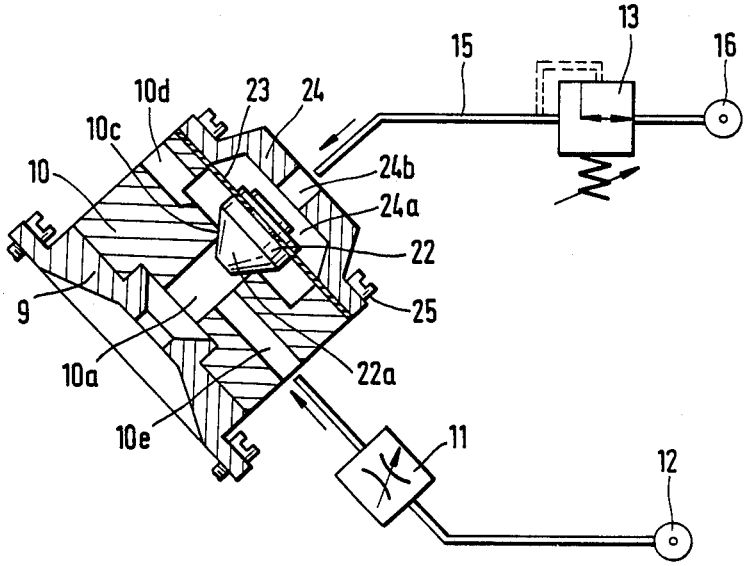

APPARATUS FOR SEPARATING AND CONVEYING THE UPPERMOST SHEET OF A STACK OF SHEETS OR SHEET-LIKE ARTICLES

CROSS REFERENCE TO RELATED APPLICATION

This application discloses subject matter which relates to subject matter disclosed in copending application, Ser. No. 839,047, now U.S. Pat. No. 4,709,912.

FIELD OF THE INVENTION

The present invention relates to an apparatus for separating and conveying the uppermost sheet of a stack of sheets or sheet-like articles by means of a suction pick-up device moved periodically relative to the surface of the stack and guided in a longitudinally displaceable manner above the stack. The direction of movement of the suction pick-up device is inclined relative to the direction of gravity at an angle such that the resultant of the reciprocating movement transmitted to the sheet in a first movement phase of the suction pick-up device and of the dropping movement executed by the sheet in a second movement phase is given a component oriented in the direction in which the sheet is conveyed.

BACKGROUND OF THE INVENTION

An apparatus of this type is the subject of German patent application DBP No. 3308867. In this apparatus, the periodic movement of the suction pick-up device is brought about by means of a valveless pump.

OBJECT AND SUMMARY OF THE INVENTION

It is an object of the present invention to improve a separating apparatus of the above type in such a manner that it can be operated by means of compressed air or a vacuum at constant pressure, which is relatively readily available for instance at factories and work places, so that the valveless pumps can be dispensed with. It should also be possible to arrange a plurality of suction pick-up devices at largely freely selectable locations in a processing machine and supply them from a central energy supply means. The suction pick-up device should form a self-contained, ready-to-assemble unit, the working frequency and vibration of which can also be adjusted if necessary by simple remote control, perhaps from some central location.

According to the invention, this object is obtained by connecting the suction pick-up device to a volume of air that is at a substantially constant negative pressure or overpressure, and by including a valve assembly between the suction pick-up device and the air volume which periodically connects the suction pick-up device with the ambient air.

Details of the invention will become apparent from the ensuing description of exemplary embodiments of the invention, taken in conjunction with the drawing.

BRIEF DESCRIPTION OF THE DRAWINGS

FIGS. 2 and 3 show different embodiments of the frequency adjustment;

DESCRIPTION OF THE PREFERRED EMBODIMENTS

Figure 1:
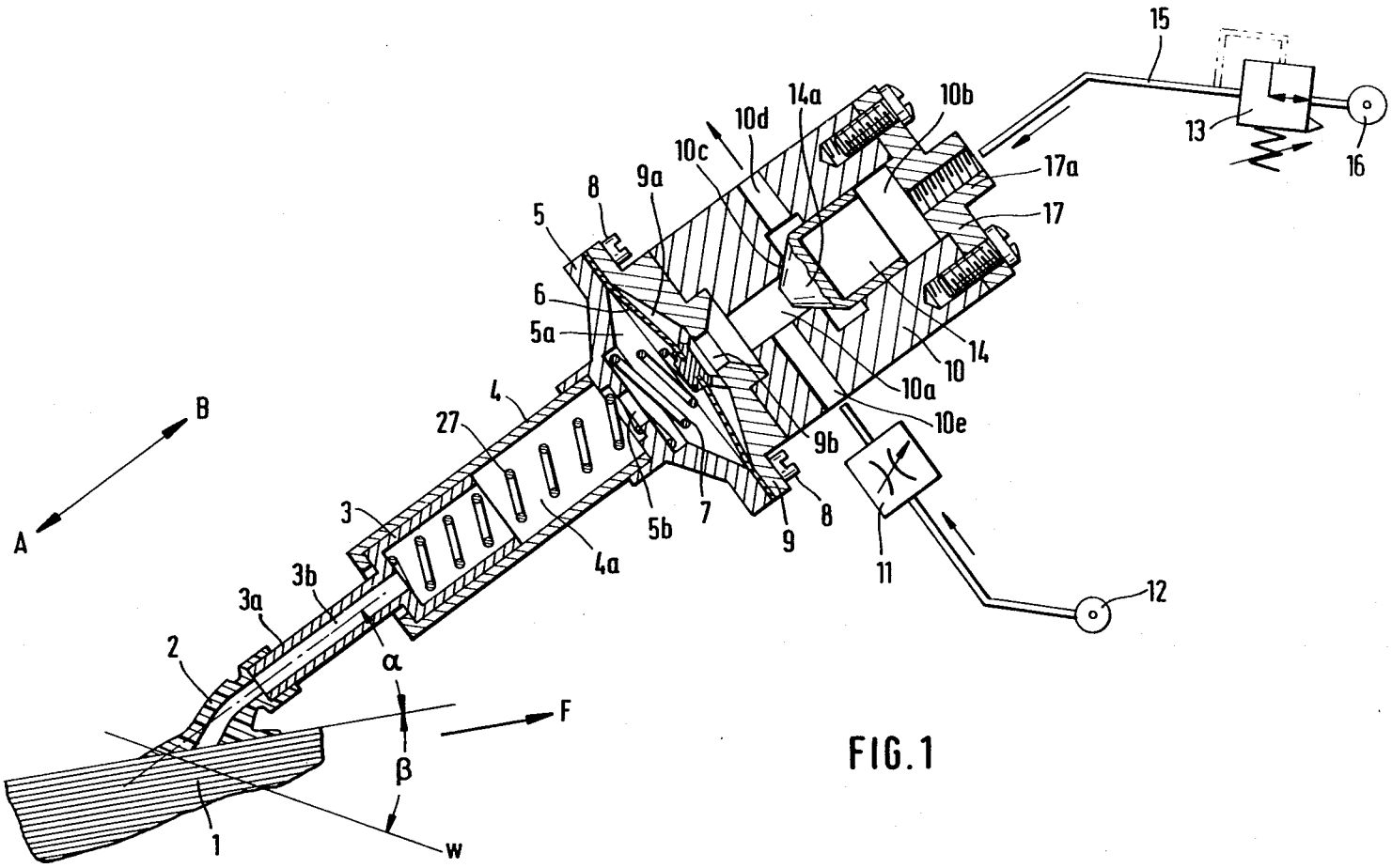
FIG. 1 is a section through a separating apparatus according to the invention having remote-controlled frequency adjustment.

As shown in FIG. 1, a suction pick-up device 2 rests on a stack of sheets 1 that is inclined backward relative to the horizontal w by an angle ($\beta$) from the direction of conveyance (F) of the sheets. The suction pick-up device 2 is secured to the shaft 3*a* of a control piston 3, which is longitudinally displaceably supported in a cylinder 4 in a direction (A-B) that is inclined by an angle ($\alpha$) from the surface of the stack. The suction pick-up device 2 is held in contact with the surface of the stack by means of a compression spring 27. The cylinder 4 is secured on a housing 5 which is secured to the frame of the sheet processing machine, for instance a copying machine, in a manner not shown in detail; the sheet processing machine receives the stack 1.

The housing 5 forms a cylinder chamber 5*a* closed off from the outside by means of a diaphragm 6. By means of a bore 5*b* the cylinder chamber 5*a* communicates with the interior 4*a* of the cylinder 4. The interior 4*a* communicates by way of a bore 3*b* with the suction pick-up device 2. A compression spring 7 acts upon the diaphragm 6, urging the diaphragm 6 to arch to the outside, i.e., away from the pick-up device 2.

By means of screws 8, a further housing 9 is secured to the housing 5 that is closed off by the diaphragm 6. This housing 9 together with the diaphragm 6 forms a further cylinder chamber 9*a*, which communicates by means of a bore 9*b* with the interior 10*a* of a valve body 10. A connection conduit 10*e* discharges into the interior 10*a* and is connected by way of a regulatable throttle 11 to an air volume of source 12 that is at substantially constant overpressure, of approximately 2 to 5 bar.

A valve seat 10*c* is formed on the outer end of the interior 10*a*, and a valve cone 14*a* formed in a cylinder chamber 10*b* rests on this valve seat 10*c* under the influence of the pressure difference prevailing in the cylinder chambers. The cylinder chamber 10*b* is closed off from the outside by means of a cap 17 bearing a connection pipe 17*a*. A control line 15, which by way of a pressure regulator 13 communicates with air volume 16, is connected to the connection pipe 17*a*. By means of the pressure regulator 13, an overpressure ranging between 0.1 and 1.0 bar can be established in the control line. Since the overpressure prevailing in the connecting conduit 10*e* when the valve cone 14*a* is resting on the valve seat 10*c* the pressure acts soley upon one portion of the piston cross section, and the slight overpressure prevailing in the control line is sufficient to keep the valve closed for a certain period of time, counter to the overpressure that is building up because of the throttle 11.

After the opening of the valve 10c, 14a, a venting conduit 10d is opened up, as a result of which the interior pressure in the chamber 10a abruptly adapts to the external air pressure. As a result the valve 10c, 14a can close under the influence of the overpressure prevailing in the control line, until such time as an overpressure sufficient to open the valve 10c, 14a has again built up in the chamber 10a because of the throttle. The frequency of this valve movement can be regulated within wide limits by adjusting the throttle 11 and the pressure regulator 13.

The air pressure prevailing in the chamber 10a is extended through the bore 9b into the cylinder chamber 9a located above the diaphragm 6, as a result of which the diaphragm 6 undergoes a corresponding flexure, which results in a corresponding pressure rise or pressure drop in the cylinder chamber 5a located below the diaphragm 6. This pressure rise or pressure drop is extended into the interior 4a communicating with the cylinder chamber 5a as well as into the suction pick up device 2 communicating with the interior 4a.

Interposing the diaphragm 6 has the advantage that as described in the previously noted German patent application, the ratio between the negative pressure prevailing in the suction pick-up device 2 and its vibration amplitude can be adapted to given prevailing conditions, such as sheet weight and the distance by which sheets are to be conveyed, by selecting a suitable diaphragm diameter. On the other hand, because of the restoring force of the diaphragm, which is reinforced by the force of the spring 7 acting upon the diaphragm 6, it becomes possible to drive the suction pick-up device 2 with purely compressed air, which as a general rule is more readily available than a vacuum. The negative pressure required to operate the suction pick-up device 2 is generated in this case by means of the spring forces acting upon the diaphragm.

In FIG. 2, the valve cone 14a of the control piston is pressed against the valve seat 10c by means of a compression spring 20. The biasing of the spring 20 is variable by means of a set screw 21 that is screwed into a thread 17b of the lid 17, so as to be able to adjust the frequency of the valve movement. The free mobility of the control piston 14 is assured by means of the bore 18 that vents the cylinder chamber 10b.

In FIG. 3, the valve cone 22a cooperating with the valve seat 10c is embodied on a valve body 22, which is secured to a diaphragm 23. The diaphragm 23 closes off a cylinder chamber 24a from below, the cylinder chamber 24a being formed below a lid 24 that is secured by means of screws 25 to the valve body 10. The cyliner diameter 24a communicates by means of a bore 24b with the control line 15, the pressure regulator 13 and the air volume 16.

Figure 4:
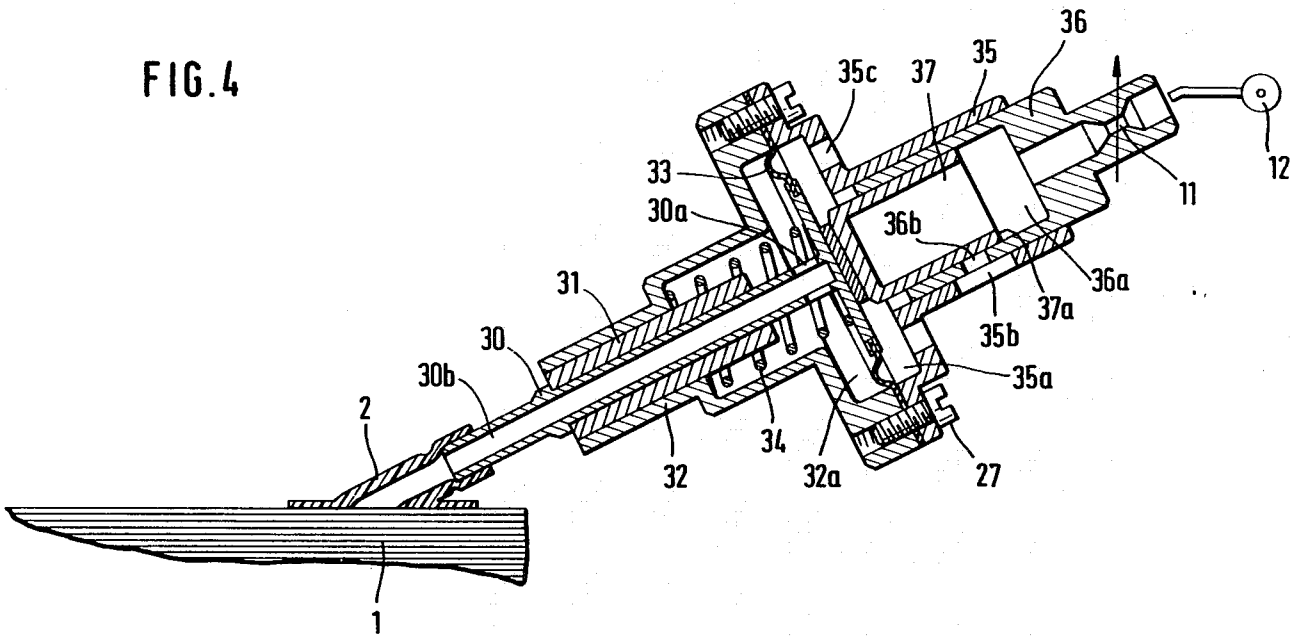
FIG. 4 shows a suction pick-up device secured to a diaphragm.

As shown in FIG. 4, a suction pick-up device 2 resting on the stack 1 is disposed on a shaft 30 in a sliding block 31 secured to a housing 32, the sliding block 31 being supported in a longitudinally displacable manner. The shaft 30 is secured on a diaphragm 33 which is subject to the action of a restoring spring 34. The cylinder chamber 32a located below the diaphragm 33 communicates by means of bores 30a, 30b of the shaft 30 with the suction pick-up device 2. The cylinder chamber 35a located above the diaphragm 33 is closed off from the outside by means of a lid 35 held by screws 27, and a guide sleeve 36 for a control piston 37 that is secured to the diaphragm 33 and supported in a longitudinally displacable manner in the guide sleeve is inserted into this lid 35. The cylinder chamber 36a located inside the guide sleeve 36 is connected via an adjustable throttle 11 to an air volume or source 12, which again has a constant overpressure of approximately 2 to 5 bar.

In this arrangement, the front edge 37a of the control piston 37 connected to the diaphragm 33 uncovers the vent openings 35b or 36b periodically, under the influence of the overpressure building up via the throttle 11. The frequency of the valve movement can be varied by the longitudinal displacement of the sleeve 36 in the lid 35. The cylinder chamber 35a located above the diaphragm 33 communicates with the atmosphere via the bore 35c.

Figure 5:
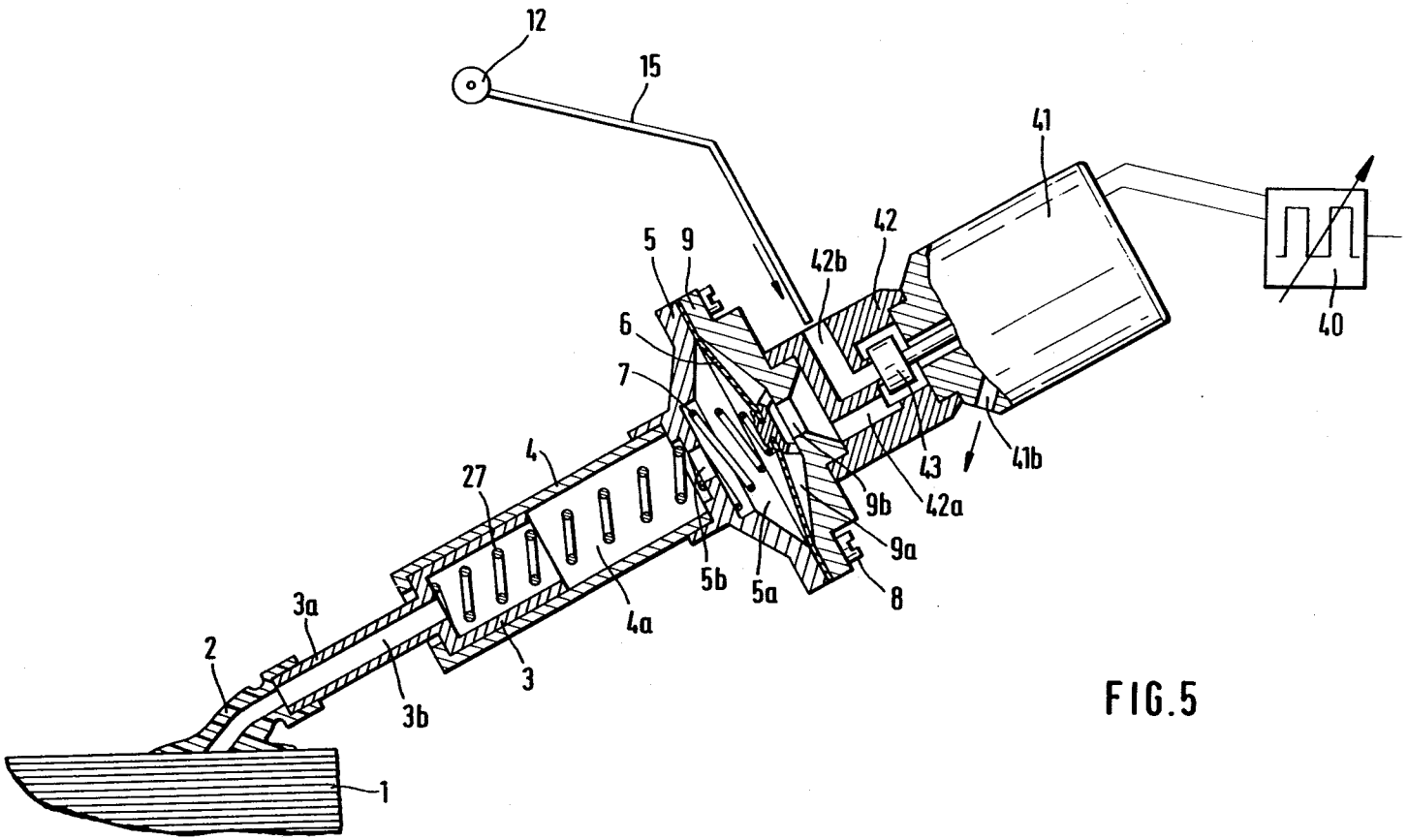
FIG. 5 shows a suction pick-up device equipped with a magnetic valve.

As shown in FIG. 5, a magnetic valve 41 is controlled by a regulatable frequency generator 40 which is mounted on the suction pick-up device 2 shown in FIG. 1. The valve plug 43 of the magnetic valve 41 connects the cylinder chamber 9a adjoining the diaphragm 6, via a bore 9b in the cap 9 and bores 42a and 42b of the valve body 42, alternately with an air volume 12 having an overpressure of 2 to 5 bar and with a vent line 41b leading to the outside air. A conventional multi-way valve available in commerce can be used for this magnetic valve. The frequency generator 40, also available in commerce, is preferably adjustable between the frequencies of 20 and 100 Hz.

Figure 6:
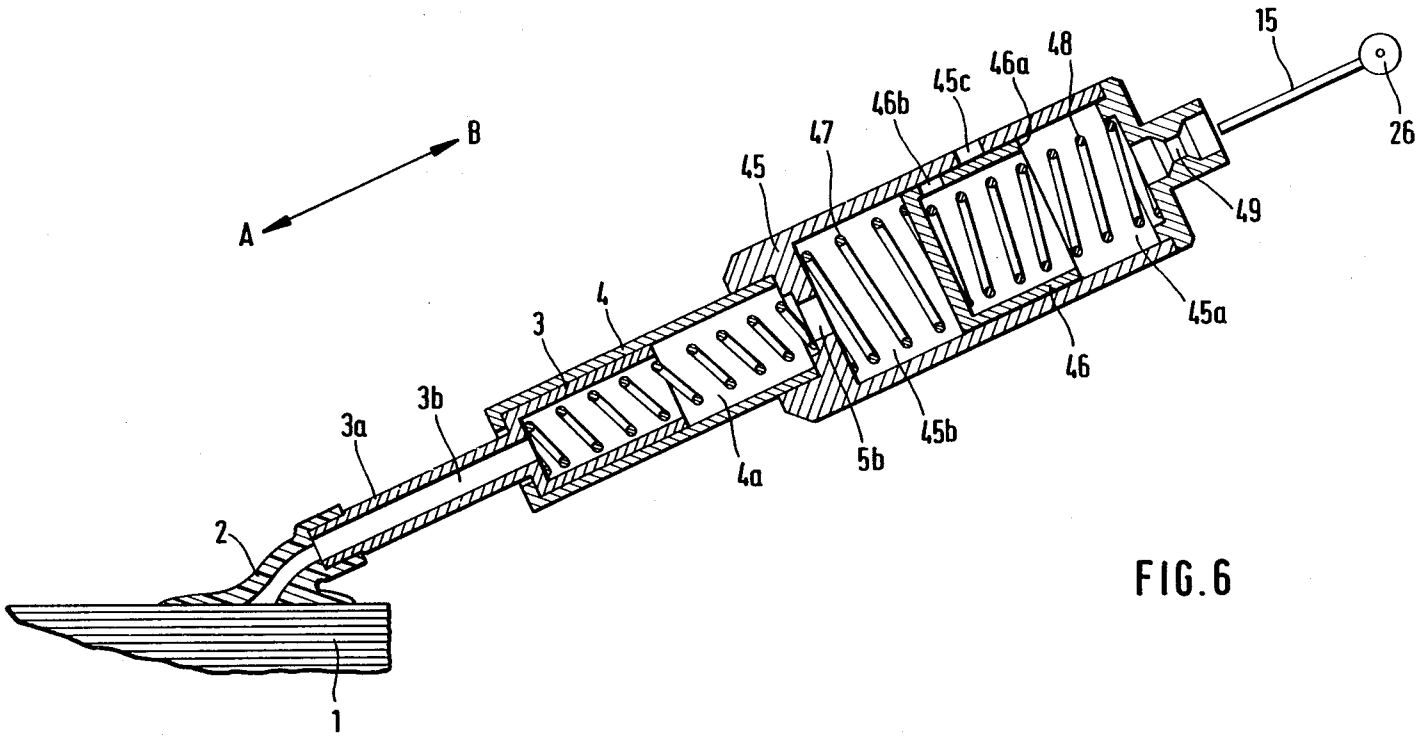
FIGS. 6 and 7 show a valve assembly equipped with a control piston and a throttle preceding it.

As shown in FIG. 6, a control piston 46 that is longitudinally displacably guided in a cylinder 45 in the direction of the arrows A-B is disposed on the suction pick-up device 2 shown in FIG. 1. The control piston 46, which divides the cylinder 45 into two cylinder chambers 45a and 45b separated from one another, is retained by two oppositely-acting compression springs 47 and 48 in an initial position located approximately in the middle of the cylinder, and it can execute periodic vibrations about this initial position.

The cylinder chamber 45a, with the interposition of a throttle 49, communicates via a connecting line 15 with an air volume 26 having a substantially constant negative pressure or overpressure of approximately 2 to 5 bar, and the cylinder chamber 45b communicates via the bore 5a with the driving cylinder 4. Depending upon whether compressed air or a vacuum is flowing through the connecting line 15, the control piston 46 is forced out of its initial position in one of its two movement directions A or B , counter to the action of the compression spring 47 or 48, to such an extent that either the control edge 46a or the control slit 46b of the piston uncovers a vent opening 45c of the cylinder 45. As a result, the control piston 46 and thus the movable suction pick-up device 2 as well are set into periodic vibrations in the direction of the arrow A-B in the above-described manner.

Figure 7:
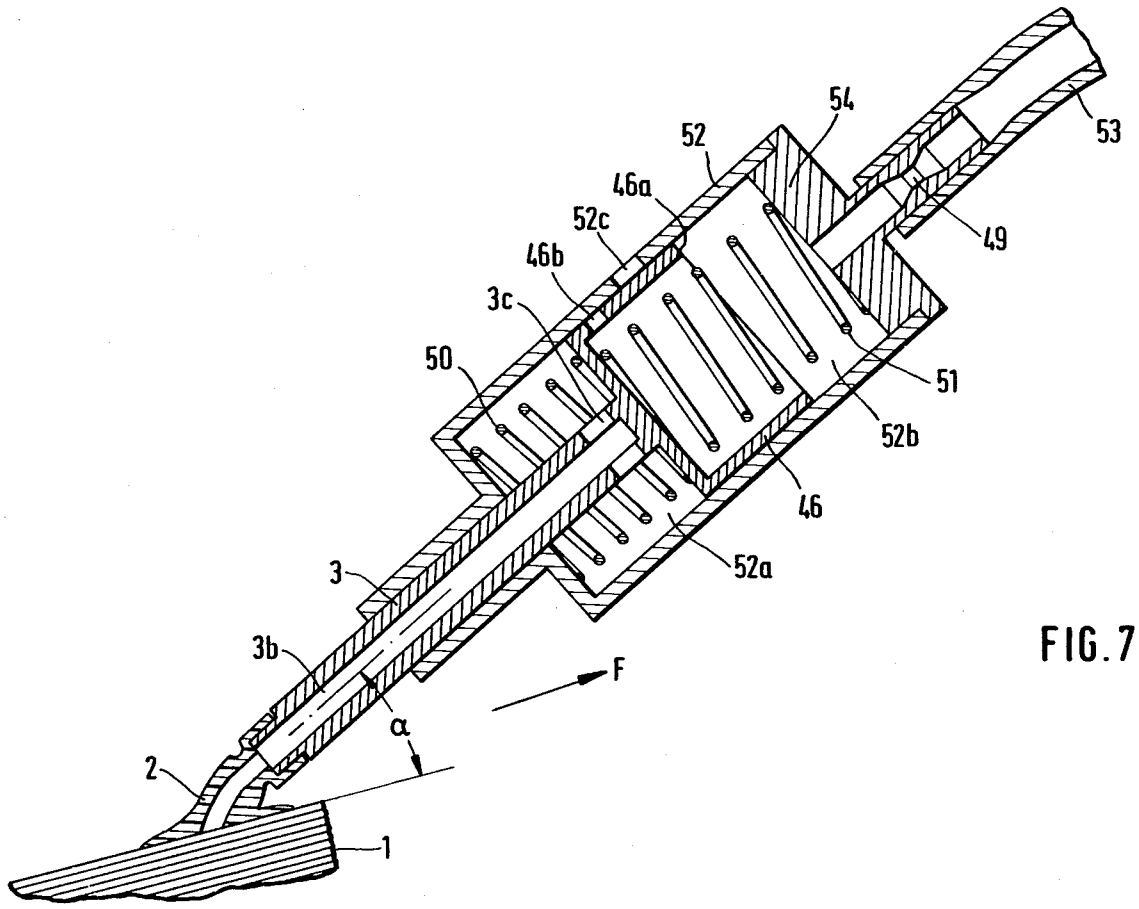

According to FIG. 7, in an arrangement otherwise corresponding to FIG. 6, the shaft 3 of the suction pick-up device 2 is directly connected to a control piston 46 supported in a cylinder 52 in a longitudinally displacable manner. The control piston 46 is retained in its initial position by two compression springs 50 and 51. It divides the cylinder 52 into two separate cylinder chamber 52a and 52b, of which the cylinder chamber 52a communicates with the suction pick-up device 2 by means of openings 3b and 3c in the shaft 3. The cylinder chamber 52b, with an interposed throttle 49, is connected to a connecting line 53 mounted on a closure cap 54 of the cylinder chamber, this connecting line leading to an air volume of constant overpressure or negative pressure, not shown in detail. The venting of the cylinder chamber 52b, in the case of a connecting line 53 that is subject to overpressure, is accomplished by means of a control edge 46a, or in the case of a connecting line 53 subject to negative pressure is accomplished by means of a control opening 46b of the control piston 46, this control edge 46a or control opening 46b periodically uncovering a venting opening 52c of the cylinder 52.

Figure 8:
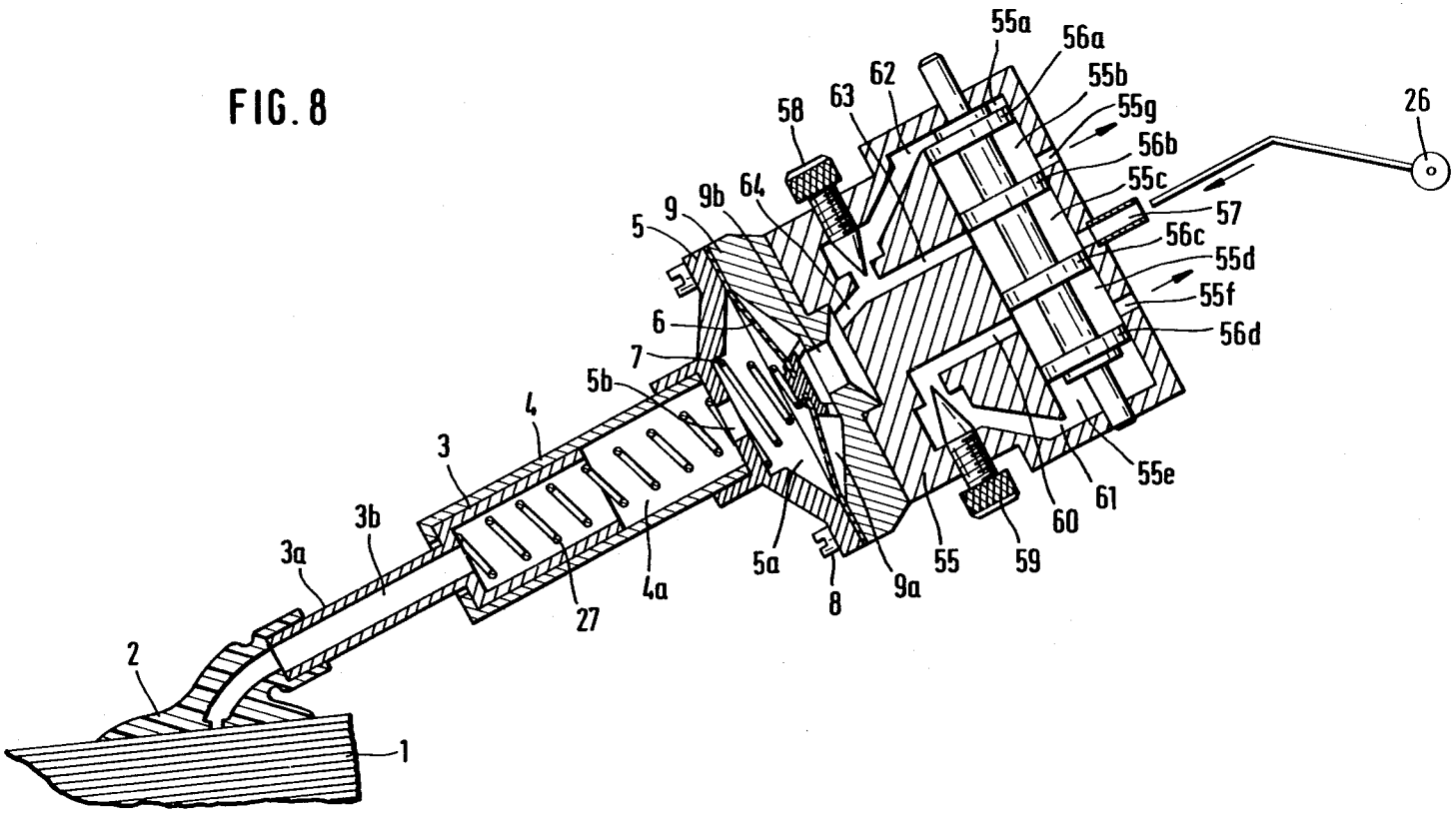
FIG. 8 shows a pneumatic multi-way valve.

In FIG. 8, with the suction pick-up device 2 otherwise being embodied as in FIG. 1, the valve arrangement is embodied by a control piston that is supported in a longitudinally displacable manner in a valve body 55 and is composed of four piston discs 56a–56d, this control piston dividing the valve body 55 into five cylinder chambers 55a–55e separate from one another. The middle cylinder chamber 55c communicates via a connecting line 57, during the entire piston movement, with an air volume or source 26 that is at constant overpressure. At the cylinder chambers 55b and 55d adjoining the middle cylinder chamber 55c, vent lines 55f and 55g are provided which communicate with the respective cylinder chamber during the entire piston movement. Furthermore, the outermost cylinder chambers 55a and 55e, each with an interposed throttle that can be regulated by means of an outer adjuster 58 or 59, respectively, communicate via respective conduits 60, 61 or 62, 63 in alternation with the cylinder chambers 55b or 55d connected to the vent lines 55g and 55f and with the cylinder chamber 55c that is permanently connected to the connecting line 57. Finally, a further connecting line 64 is provided which connects one of the cylinder chambers 55a or 55b that communicates alternatively with the connecting line 57 and with one of the two vent lines 55g or 55f to the cylinder chamber 9a that is closed off by the diaphragm 6.

Figure 9:
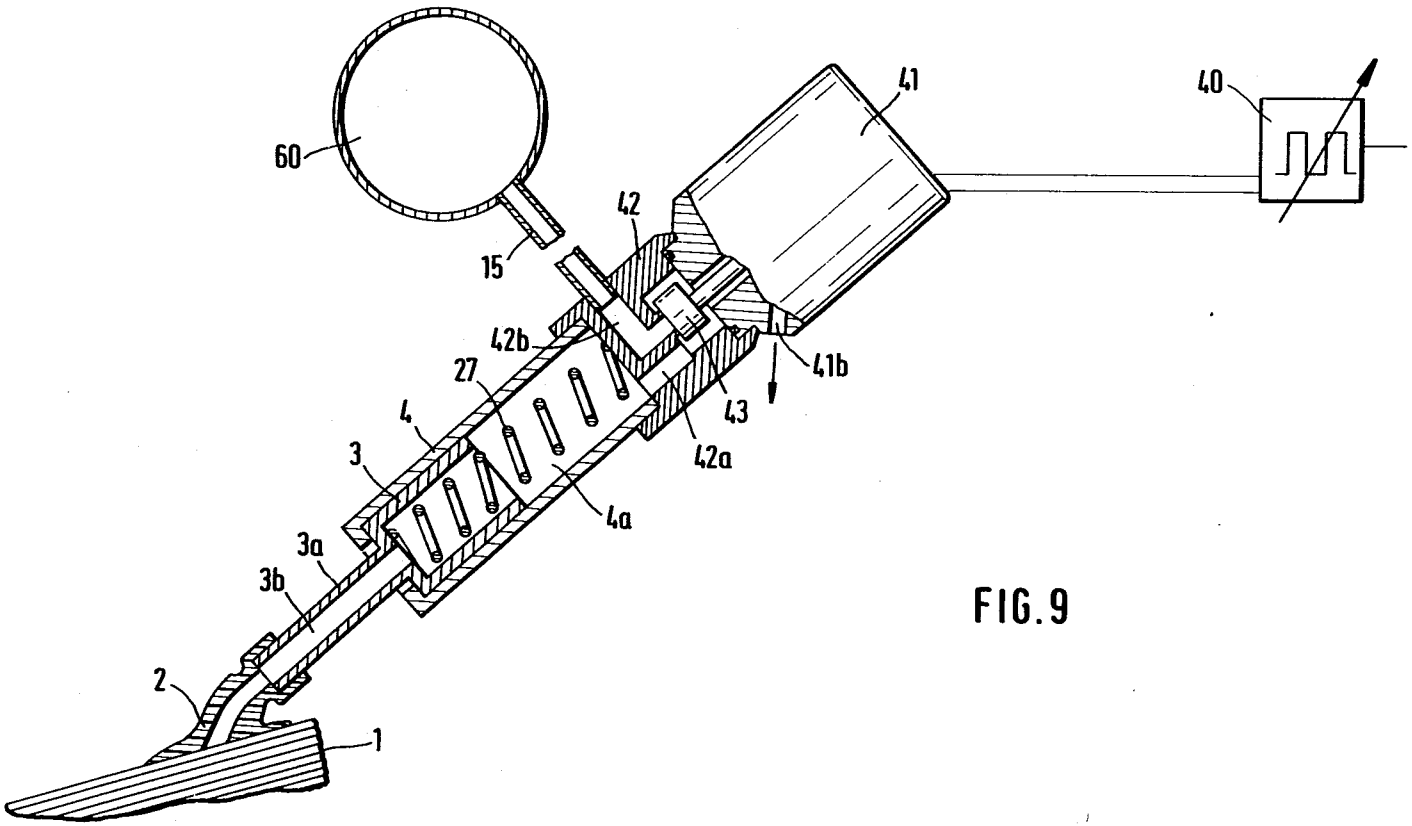
FIG. 9 shows a further suction pick-up device equipped with a magnetic valve.

FIG. 9 shows an arrangement in which similarly to that of FIG. 5, the periodic connection of the suction pick-up device 2 to an air volume or source 60 that is permanently subject to negative pressure is accomplished by means of a magnetic valve 41 controlled by a frequency generator 40. Differing from the arrangement of FIG. 5, however, in this case the driving cylinder 4 of the suction pick-up device 2 is connected directly to the valve assembly 42 by means of the connecting conduit 42a.

Figures 10, 11:
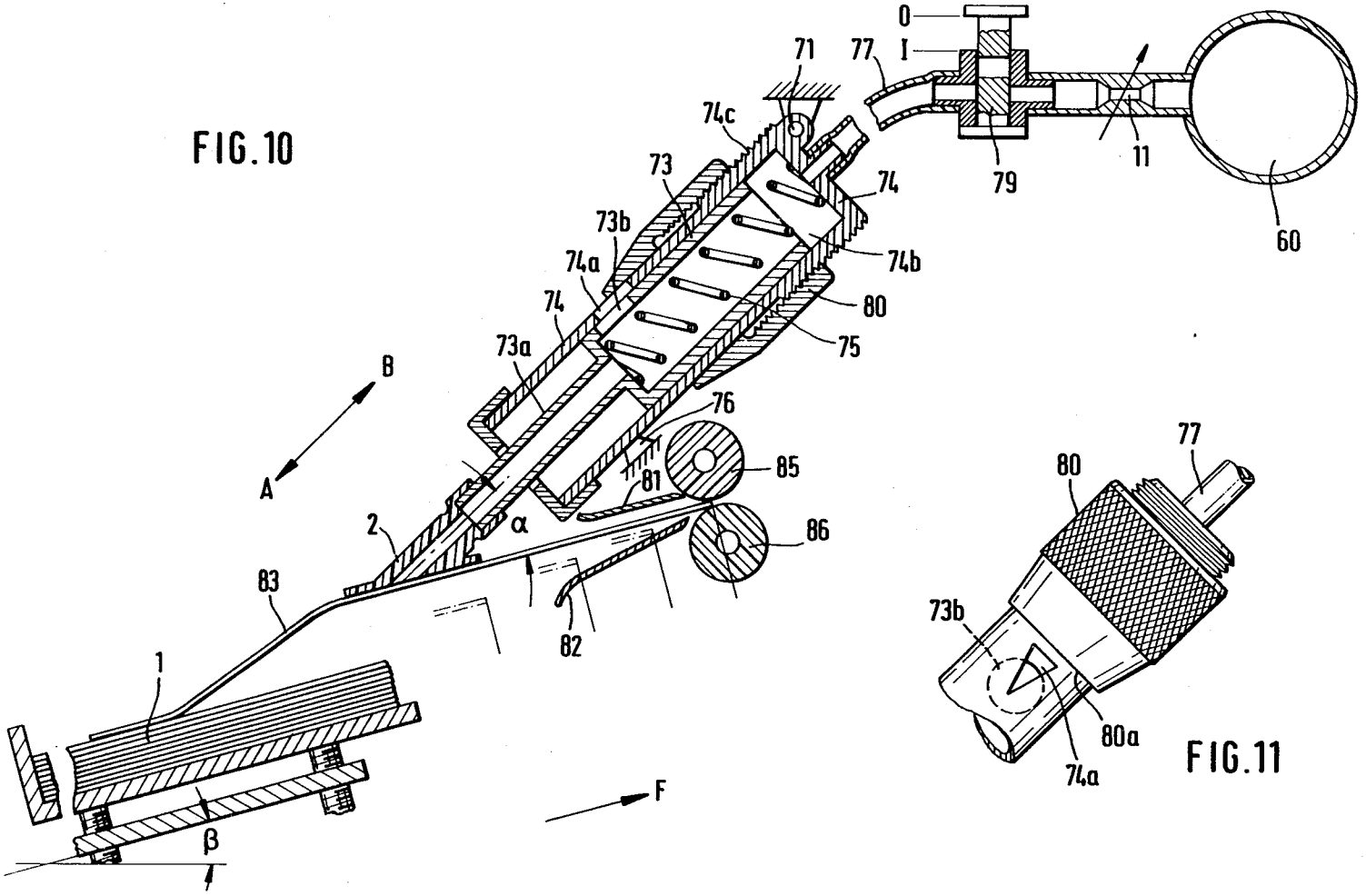
FIG. 10 shows a separating device with a regulatable throttle in the venting line.
FIG. 11 shows details of the throttle.

In FIGS. 10 and 11, a suction pick-up device that is pivotable about a shaft 71 to touch the uppermost sheet of the stack is arranged above a stack 1 of sheets, the stack being inclined relative to the horizontal by an angle ($\beta$). The suction pick up device 2 is secured to the shaft 73a of a control piston 73 that is guided in a longitudinally displacable manner in a cylinder 74 in a direction indicated by the arrows A-B that is inclined by an angle ($\alpha$) relative to the surface of the stack 1. The control piston 73 is subject to the action of a compression spring 75, which tends to keep the suction pick up device 2 in contact with the surface of the stack when the cylinder has been pivoted against a stop 76 attached to the frame.

A flexible connecting line 77 is mounted on the upper end the cylinder 74, effecting communication between the cylinder chamber 74b and a vacuum container 60, with an interposed adjustable throttle 11. A reversible valve 79 is introduced into the connecting line 77, and in its position 0 this valve 79 interrupts the passage of air, while in the position I it opens up this passage of air.

At the circumference of the cylinder 74, a vent opening 74a is provided, which in the uppermost position of the control piston 73b comes to coincide with a vent opening 73 in the piston. As seen in FIG. 11 the vent opening 73b of the control piston 73 has a circular cross section while the vent opening 74a of the cylinder 74 has a triangular cross section. The vent opening 74a of the cylinder can be covered by means of the front edge 80a of a sleeve 80 that surrounds the cylinder 74, this sleeve 80 being screwed onto a thread 74c of the cylinder 74.

Following the stack 1 as viewed in the direction of conveyance F, guide panels 81 and 82 are provided, which guide the sheet 83 that has been removed from the stack toward a pair of conveyor rollers 85 and 86.

Figure 12:
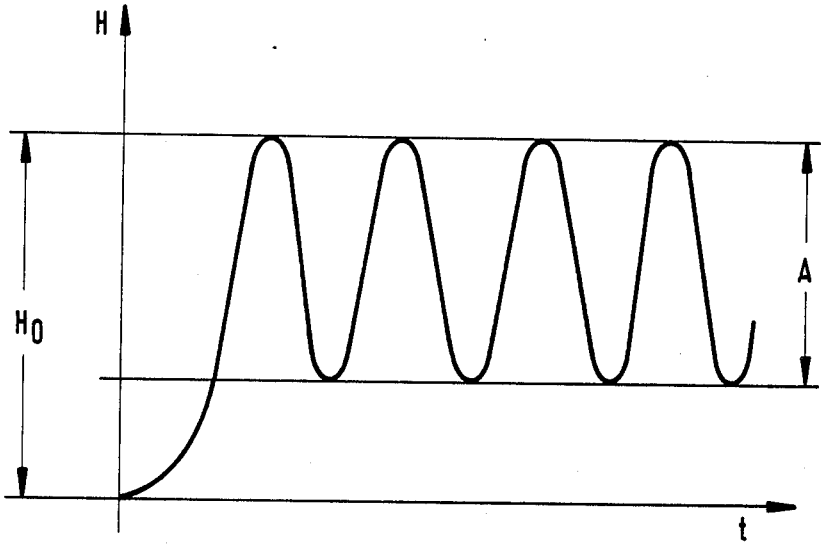
FIGS. 12 and 13 show the movement characteristic of the suction pick-up device which is dependent on the throttle setting.

FIG. 12 shows the curve of the suction pick-up stroke H as a function of time t, for the case where the effective cross section of the vent opening 73b and 74a notably exceeds the effective cross section of the throttle 11. Then, when valve position I is actuatued, the suction pick-up device is raised into its uppermost position, characterized by the stroke $H_O$, counter to the action of the restoring spring 75, by means of the negative pressure prevailing in the connecting line; in this position, the vent opening 73b and 74a are fully opened. Because of the thus ensuing pressure drop, the control piston together with the suction pick-up device secured to it immediately begin to drop, as a result of which the vent openings close again, which enables the renewed buildup of a negative pressure in the cylinder chamber 74b through the connecting line 77 or the throttle 11. From this alternating operation, the result is a periodic vibration of the suction pick-up device, extending as far as the height $H_O$, with the substantially constant amplitude A. This amplitude A and the vibration frequency of the suction pick-up device are dependent not only on the inertia conditions prevailing at the suction pick-up device or at the control piston but above all on the cross sectional ratio, which can be adjusted at the throttle 11, of the throttle and the vent openings 73b and 74a.

Figure 13:
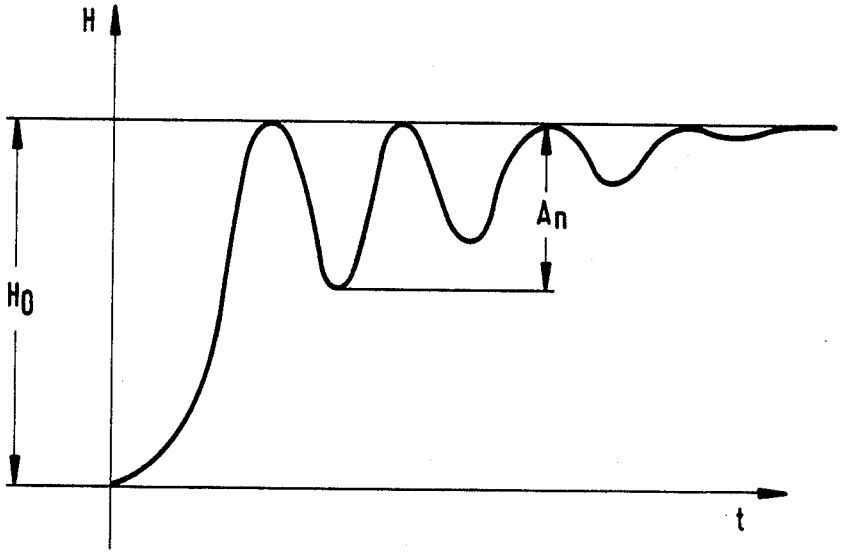

If the cross section of the vent opening 73b, 74a is now varied, by adjusting the sleeve 80, in such a manner that the cylinder chamber 74b is ventilated in a correspondingly slower manner, then the control piston 73, with the suction pick-up device 2 secured on it, still does attain its full stroke height $H_O$ as before, in which case the vent opening 73b of the control piston 73 and the vent opening 74a of the cylinder 74 come to coincide. However, after the vent openings have been uncovered, the control piston 73 returns to its lower reversal position in a correspondingly slower manner, so that its vibration width becomes progressively smaller. (See FIG. 13.) The result is a variable amplitude $A_n$, which after a number of vibrations that is adjustable by mean of the sleeve 80 tends to become 0; this amplitude causes the control piston 73 finally to remain in its uppermost position. Thus as shown in dashed lines in FIG. 10, the component of the suction pick-up movement that acts in the conveyor direction F also becomes smaller from one stroke to the next, until it likewise disapears. By correspoldingly adjusting the sleeve 80, it can be accomplished that the conveyed sheet 83 approaches the pair of conveyor rollers 85, 86 at a progressively slower speed, which precludes any danger of damage to the front edge of the sheet, and once it reaches this pair of conveyor rollers, or once the sheet has arched in a known manner in front of the pair of conveyor rollers, it comes to a stop without producing friction at the sheet that would tend to wear down the sheet. Once the conveyor roller movement has been switched on, the sheet can be received by the pair of conveyor rollers 85, 86 in a likewise known manner, with the arch in the sheet being smoothed out once again.

What is claimed is:

1. An apparatus for separating the uppermost sheet from a stack of sheets and conveying said uppermost sheet in a direction essentially parallel to a plane defined by said sheets, comprising:

(a) a suction pick-up device with a suction opening, for contact with said uppermost sheet, said suction pick-up device being inclined with respect to the direction of conveyance of said sheets;

(b) a control piston carrying said pick-up device and provided with an interior chamber, said chamber being in connection with said suction opening of said pick-up device;

(c) spring means to urge said control piston in the direction, in which the pick-up device will come into contact with said uppermost sheet;

(d) a cylinder for receiving said control piston such that said control piston can move therein reciprocatingly into contact with and away from said uppermost sheet, the direction of reciprocation having the same inclination with respect to the direction of conveyance of said sheets as the pick-up device, and the interior of the cylinder being in communication with said interior chamber of the control piston;

(e) a vacuum source in communication with said chamber of said control piston such that the negative pressure provided by said vacuum source is effective;

(aa) to hold the uppermost sheet against the pick-up device upon contact of the pick-up device with said sheet thereby closing said suction opening in said pick-up device, and (bb) to retract the control piston into said cylinder; and (f) vent means provided at said cylinder and said control piston to effect a reduction of the negative pressure within said chamber of said control piston, when said control piston is in its retracted position, thereby dropping said uppermost sheet and allowing the control piston to move in the direction urged upon it by said spring means;

such that by opening and closing of said vent means a periodic vibration of the pick-up device to and away from said uppermost sheet is generated, which moves said uppermost sheet in the conveyance direction.

2. The apparatus as defined in claim 1, further comprising:

(g) a connecting line connected between said chamber of said control piston and of said vacuum source; and (h) a throttle located in the connecting line, said throttle having a cross section less than the opening of said vent means.

3. The apparatus as defined in claim 1, wherein said vent means includes a vent opening, and throttle means for controlling the opening of the vent opening.

* * * * *